US008934650B1

(12) United States Patent
Norris et al.

(10) Patent No.: US 8,934,650 B1
(45) Date of Patent: Jan. 13, 2015

(54) LOW PROFILE PARAMETRIC TRANSDUCERS AND RELATED METHODS

(71) Applicant: Parametric Sound Corporation, Poway, CA (US)

(72) Inventors: Elwood G. Norris, Poway, CA (US); John Bolton, Poway, CA (US); Julian Groeli, Poway, CA (US); Jin Chen, Poway, CA (US)

(73) Assignee: Turtle Beach Corporation, Poway, CA (US)

( * ) Notice: Subject to any disclaimer, the term of this patent is extended or adjusted under 35 U.S.C. 154(b) by 0 days.

(21) Appl. No.: 13/935,246

(22) Filed: Jul. 3, 2013

Related U.S. Application Data

(60) Provisional application No. 61/667,833, filed on Jul. 3, 2012.

(51) Int. Cl.
*H04R 25/00* (2006.01)
*H04R 1/02* (2006.01)

(52) U.S. Cl.
CPC ..... *H04R 1/021* (2013.01)
USPC ..... 381/190; 381/173

(58) Field of Classification Search
CPC ..... B60B 1/0292; H04R 1/222; H04R 15/00; H04R 17/00; H04R 17/02; H04R 17/005; H04R 17/045; H04R 19/00; H04R 19/01; H04R 19/02; H04R 19/016; H04R 19/06; H04R 21/02; H04R 2499/11
USPC ..... 381/173, 190, 191, 345
See application file for complete search history.

(56) References Cited

U.S. PATENT DOCUMENTS

| | | | |
|---|---|---|---|
| 1,616,639 | A | 2/1927 | Sprague |
| 1,764,008 | A | 6/1930 | Crozier |
| 1,799,053 | A | 3/1931 | Mache |
| 1,809,754 | A | 6/1931 | Steedle |

(Continued)

FOREIGN PATENT DOCUMENTS

| | | |
|---|---|---|
| JP | H2265400 | 10/1990 |
| WO | WO01/08449 | 2/2001 |

(Continued)

OTHER PUBLICATIONS

Berktay et al; Possible Exploitation of Non-Linear Acoustics in Underwater Transmitting Applications, J. Sound Vib., Apr. 13, 1965, vol. 2, No. 4, pp. 435-461.

(Continued)

*Primary Examiner* — Brian Ensey
(74) *Attorney, Agent, or Firm* — Thorpe North & Western LLP

(57) ABSTRACT

A low profile ultrasonic emitter comprises a support member operable to support an ultrasonic emittive material, the support member including a plurality of support ribs, each support rib being spaced from adjacent support ribs and extending longitudinally along the support member. An ultrasonic emittive film is coupled to upper portions of the support ribs so as to be carried by the support member. A first electric lead is coupled to a first face of the emittive film and a second electric lead coupled to an opposing face of the emittive film. The first and second leads are coupled to their respective faces adjacent one another but staggered from one another so as to not overlap one another when the film is positioned between the leads.

7 Claims, 14 Drawing Sheets

(56) References Cited

U.S. PATENT DOCUMENTS

| | | | |
|---|---|---|---|
| 1,951,669 | A | 3/1934 | Ramsey |
| 1,983,377 | A | 12/1934 | Kellogg |
| 2,461,344 | A | 2/1949 | Olson |
| 2,855,467 | A | 10/1958 | Curry |
| 2,872,532 | A | 2/1959 | Buchmann et al. |
| 2,935,575 | A | 5/1960 | Bobb |
| 2,975,243 | A | 3/1961 | Katella |
| 2,975,307 | A | 3/1961 | Schroeder et al. |
| 3,008,013 | A | 11/1961 | Williamson et al. |
| 3,012,222 | A | 12/1961 | Hagemann |
| 3,136,867 | A | 6/1964 | Brettell |
| 3,345,469 | A | 10/1967 | Rod |
| 3,373,251 | A | 3/1968 | Seeler |
| 3,389,226 | A | 6/1968 | Peabody |
| 3,398,810 | A | 8/1968 | Clark, III |
| 3,461,421 | A | 8/1969 | Stover |
| 3,544,733 | A | 12/1970 | Reylek |
| 3,612,211 | A | 10/1971 | Clark, III |
| 3,613,069 | A | 10/1971 | Cary, Jr. |
| 3,654,403 | A | 4/1972 | Bobb |
| 3,674,946 | A | 7/1972 | Winey |
| 3,710,332 | A | 1/1973 | Tischner et al. |
| 3,723,957 | A | 3/1973 | Damon |
| 3,742,433 | A | 6/1973 | Kay et al. |
| 3,787,642 | A | 1/1974 | Young, Jr. |
| 3,816,774 | A | 6/1974 | Ohnuki et al. |
| 3,821,490 | A | 6/1974 | Bobb |
| 3,829,623 | A | 8/1974 | Willis et al. |
| 3,833,771 | A | 9/1974 | Collinson |
| 3,836,951 | A | 9/1974 | Geren et al. |
| 3,892,927 | A | 7/1975 | Lindenberg |
| 3,919,499 | A | 11/1975 | Winey |
| 3,941,946 | A | 3/1976 | Kawakami et al. |
| 3,997,739 | A | 12/1976 | Kishikawa et al. |
| 4,056,742 | A | 11/1977 | Tibbetts |
| 4,064,375 | A | 12/1977 | Russell et al. |
| 4,160,882 | A | 7/1979 | Driver |
| 4,207,571 | A | 6/1980 | Passey |
| 4,210,786 | A | 7/1980 | Winey |
| 4,242,541 | A | 12/1980 | Ando |
| 4,245,136 | A | 1/1981 | Krauel, Jr. |
| 4,284,921 | A | 8/1981 | Lemonon et al. |
| 4,289,936 | A | 9/1981 | Civitello |
| 4,295,214 | A | 10/1981 | Thompson |
| 4,322,877 | A | 4/1982 | Taylor |
| 4,378,596 | A | 3/1983 | Clark |
| 4,385,210 | A | 5/1983 | Marquiss |
| 4,418,404 | A | 11/1983 | Gordon et al. |
| 4,419,545 | A | 12/1983 | Kuindersma |
| 4,429,193 | A | 1/1984 | Busch-Vishniac et al. |
| 4,439,642 | A | 3/1984 | Reynard |
| 4,471,172 | A | 9/1984 | Winey |
| 4,480,155 | A | 10/1984 | Winey |
| 4,514,773 | A | 4/1985 | Susz |
| 4,550,228 | A | 10/1985 | Walker et al. |
| 4,558,184 | A | 12/1985 | Busch-Vishniac et al. |
| 4,593,160 | A | 6/1986 | Nakamura |
| 4,593,567 | A | 6/1986 | Isselstein et al. |
| 4,672,591 | A | 6/1987 | Breimesser et al. |
| 4,695,986 | A | 9/1987 | Hossack |
| 4,751,419 | A | 6/1988 | Takahata |
| 4,803,733 | A | 2/1989 | Carver et al. |
| 4,823,908 | A | 4/1989 | Tanaka et al. |
| 4,837,838 | A | 6/1989 | Thigpen et al. |
| 4,872,148 | A | 10/1989 | Kirby et al. |
| 4,885,781 | A | 12/1989 | Seidel |
| 4,887,246 | A | 12/1989 | Hossack et al. |
| 4,888,086 | A | 12/1989 | Hossack et al. |
| 4,903,703 | A | 2/1990 | Igarashi et al. |
| 4,908,805 | A | 3/1990 | Sprenkels et al. |
| 4,939,784 | A | 7/1990 | Bruney |
| 4,991,148 | A | 2/1991 | Gilchrist |
| 5,018,203 | A | 5/1991 | Sawyers et al. |
| 5,054,081 | A | 10/1991 | West |
| 5,115,672 | A | 5/1992 | McShane et al. |
| 5,142,511 | A | 8/1992 | Kanai et al. |
| 5,153,859 | A | 10/1992 | Chatigny et al. |
| 5,210,803 | A | 5/1993 | Martin et al. |
| 5,287,331 | A | 2/1994 | Schindel et al. |
| 5,317,543 | A | 5/1994 | Grosch |
| 5,357,578 | A | 10/1994 | Taniishi |
| 5,361,381 | A | 11/1994 | Short |
| 5,392,358 | A | 2/1995 | Driver |
| 5,430,805 | A | 7/1995 | Stevenson et al. |
| 5,487,114 | A | 1/1996 | Dinh |
| 5,539,705 | A | 7/1996 | Akerman et al. |
| 5,638,456 | A | 6/1997 | Conley et al. |
| 5,684,884 | A | 11/1997 | Nakaya et al. |
| 5,700,359 | A | 12/1997 | Bauer |
| 5,859,915 | A | 1/1999 | Norris |
| 5,885,129 | A | 3/1999 | Norris |
| 5,889,870 | A | 3/1999 | Norris |
| 6,011,855 | A | 1/2000 | Selfridge et al. |
| 6,041,129 | A | 3/2000 | Adelman |
| 6,106,399 | A | 8/2000 | Baker et al. |
| 6,108,427 | A | 8/2000 | Norris et al. |
| 6,151,398 | A | 11/2000 | Norris |
| 6,188,772 | B1 | 2/2001 | Norris et al. |
| 6,229,899 | B1 | 5/2001 | Norris et al. |
| 6,241,612 | B1 | 6/2001 | Heredia |
| 6,304,662 | B1 | 10/2001 | Norris et al. |
| 6,411,015 | B1 | 6/2002 | Toda |
| 6,498,531 | B1 | 12/2002 | Ulrick et al. |
| 6,556,687 | B1 | 4/2003 | Manabe |
| 6,584,205 | B1 | 6/2003 | Croft, III et al. |
| 6,606,389 | B1 | 8/2003 | Selfridge et al. |
| 6,628,791 | B1 | 9/2003 | Bank et al. |
| 6,631,196 | B1 | 10/2003 | Higgins et al. |
| 6,775,388 | B1 | 8/2004 | Pompei |
| 6,914,991 | B1 | 7/2005 | Pompei |
| 6,975,731 | B1 | 12/2005 | Cohen et al. |
| 7,162,042 | B2 | 1/2007 | Spencer et al. |
| 7,369,665 | B1 | 5/2008 | Cheng |
| 7,536,008 | B2 | 5/2009 | Howes et al. |
| 7,564,981 | B2 | 7/2009 | Croft, III |
| 7,596,229 | B2 | 9/2009 | Croft, III |
| 7,657,044 | B2 | 2/2010 | Pompei |
| 7,667,444 | B2 | 2/2010 | Mevay et al. |
| 7,729,498 | B2 | 6/2010 | Spencer et al. |
| 7,850,526 | B2 | 12/2010 | Mao |
| 7,957,163 | B2 | 6/2011 | Hua |
| 8,027,488 | B2 | 9/2011 | Pompei |
| 8,106,712 | B2 | 1/2012 | Lee |
| 8,165,328 | B2 | 4/2012 | Thomsen |
| 8,391,514 | B2 | 3/2013 | Norris |
| 2004/0052387 | A1* | 3/2004 | Norris et al. ..... 381/190 |
| 2005/0008168 | A1* | 1/2005 | Pompei ..... 381/77 |
| 2005/0008268 | A1 | 1/2005 | Plourde et al. |
| 2005/0086058 | A1 | 4/2005 | Lemelson et al. |
| 2005/0100181 | A1* | 5/2005 | Croft et al. ..... 381/190 |
| 2005/0152561 | A1 | 7/2005 | Spencer |
| 2005/0195985 | A1 | 9/2005 | Croft, III et al. |
| 2005/0220311 | A1 | 10/2005 | Sun et al. |
| 2006/0025214 | A1 | 2/2006 | Smith |
| 2006/0215841 | A1 | 9/2006 | Vieilledent et al. |
| 2007/0154035 | A1 | 7/2007 | Fukui |
| 2007/0211574 | A1 | 9/2007 | Croft, III |
| 2008/0261693 | A1 | 10/2008 | Zalewski |
| 2008/0279410 | A1 | 11/2008 | Cheung et al. |
| 2010/0016727 | A1 | 1/2010 | Rosenberg |
| 2010/0040249 | A1 | 2/2010 | Lenhardt |
| 2010/0414447 | | 2/2010 | Graylin |
| 2010/0166222 | A1 | 7/2010 | Bongiovi |
| 2010/0302015 | A1 | 12/2010 | Kipman et al. |
| 2011/0018710 | A1 | 1/2011 | Booij et al. |
| 2011/0044467 | A1 | 2/2011 | Pompei |
| 2011/0051977 | A1 | 3/2011 | Losko et al. |
| 2011/0077080 | A1 | 3/2011 | Meer |
| 2011/0103614 | A1 | 5/2011 | Cheung et al. |
| 2011/0212777 | A1 | 9/2011 | Chen |
| 2011/0216928 | A1 | 9/2011 | Eisenberg et al. |
| 2012/0029912 | A1 | 2/2012 | Almagro |
| 2012/0051556 | A1 | 3/2012 | Pompei |
| 2012/0057734 | A1 | 3/2012 | Schulein et al. |

(56) References Cited

U.S. PATENT DOCUMENTS

| | | | |
|---|---|---|---|
| 2012/0148070 | A1 | 6/2012 | Norris |
| 2012/0148082 | A1 | 6/2012 | Norris |
| 2014/0133668 | A1 | 5/2014 | Podoloff |
| 2014/0161282 | A1 | 6/2014 | Norris |
| 2014/0161291 | A1 | 6/2014 | Matsuzawa |

FOREIGN PATENT DOCUMENTS

| | | | |
|---|---|---|---|
| WO | WO01/15491 | | 3/2001 |
| WO | WO01/52437 | | 7/2001 |
| WO | WO 2008/046175 | A1 | 4/2008 |
| WO | WO 2013/158298 | | 10/2013 |

OTHER PUBLICATIONS

Crandall et al; The Air-Damped Vibrating System: Theoretical Calibration of the Condenser Transmitter; American Physical Society; Dec. 28, 1917; pp. 449-460.

Makarov et al; Parametric Acoustic Nondirectional Radiator; Acustica; 1992; vol. 77, pp. 240-242.

PCT Application PCT/US2013/021064; Filed Jan. 10, 2013; Parametric Sound Corporation; International Search Report Mailed May 16, 2013.

Westervelt; Parametric Acoustic Array; The Journal of the Acoustical Society of America; Apr. 1963; vol. 35, No. 1, pp. 535-537.

U.S. Appl. No. 13/738,887, filed Jan. 10, 2013; Elwood G. Norris.

U.S. Appl. No. 13/761,484, filed Feb. 7, 2013; Elwood G. Norris.

U.S. Appl. No. 13/837,237, filed Mar. 15, 2013; Elwood G. Norris.

U.S. Appl. No. 13/863,971, filed Apr. 16, 2013; Elwood G. Norris.

U.S. Appl. No. 13/917,273, filed Jun. 13, 2013; Elwood G. Norris.

U.S. Appl. No. 13/917,315, filed Jun. 13, 2013; Elwood G. Norris.

U.S. Appl. No. 13/160,051, filed Jun. 14, 2011; Elwood G. Norris; Office Action issued Jul. 19, 2013.

Wagner; Electrostatic Loudspeaker Design and Construction; Audio Amateur Press Publishers; 1993; Chapters 4-5; pp. 59-91.

Yoneyama et al.; The Audio Spotlight: An Application of Nonlinear Interaction of Sound Waves to a New Type of Loudspeaker Design; Acoustical Society of America; 1983; vol. 73, No. 5; pp. 1532-1536.

Aoki et al; Parametric Loudspeaker-Characteristics of Acoustic Field and Suitable Modulation of Carrier Ultrasound, Electronics and Communications in Japan, Part 3, vol. 74, No. 9, 1991, pp. 76-82.

U.S. Appl. No. 13/160,048, filed Jun. 14, 2011; Elwood G. Norris; office action dated Oct. 1, 2013.

U.S. Appl. No. 13/160,051, filed Jun. 14, 2011; Elwood G. Norris; office action dated Oct. 31, 2013.

U.S. Appl. No. 13/761,484, filed Feb. 7, 2013; Elwood G. Norris; office action dated Nov. 4, 2013.

PCT Application PCT/US2014/018691; filing date Mar. 26, 2014; Parametric Sound Corporation; International Search report mailed Jun. 6, 2014.

* cited by examiner

LOW PROFILE PARAMETRIC TRANSDUCERS AND RELATED METHODS

PRIORITY CLAIM

Priority is claimed of U.S. Provisional Patent Application Ser. No. 61/667,833, filed Jul. 3, 2012, which is hereby incorporated herein by reference in its entirety.

BACKGROUND OF THE INVENTION

1. Field of the Invention

The present invention relates generally to the field of parametric loudspeakers used to produce useful audible sound. More particularly, the present invention is related to such loudspeakers that are provided in a very low profile, or thin, configuration.

2. Related Art

Non-linear transduction, such as a parametric array in air, results from the introduction of sufficiently intense, audio modulated ultrasonic signals into an air column. Self demodulation, or down-conversion, occurs along the air column resulting in the production of an audible acoustic signal. This process occurs because of the known physical principle that when two sufficiently intense sound waves with different frequencies are radiated simultaneously in the same medium, a modulated waveform including the sum and difference of the two frequencies is produced by the non-linear (parametric) interaction of the two sound waves. When the two original sound waves are ultrasonic waves and the difference between them is selected to be an audio frequency, an audible sound can be generated by the parametric interaction. Emitters suitable for producing such an effect are referred to herein as "parametric emitters."

While parametric emitters have been produced using a variety of materials, including piezoelectric crystals, PVDF films, electrostatic emitters, other membrane-type acoustic transducers and the like, they have conventionally been constructed as rather large, bulky units or a larger array consisting of multiple transducers. However, current trends in visual displays are requiring ever slimmer televisions, computer monitors, point-of sale displays, and the like. Thus, while consumers can now obtain video components that have a very low profile (e.g., a very small thickness or depth), many times the speakers available for use with such video components have a much larger profile than the video component, somewhat negating the positive gains achieved in reducing the size of video displays. This is particularly true for parametric emitters, which have conventionally required relatively large cabinets to contain the required emittive material, circuitry, arrays, etc.

Even when a very thin emittive material is used in a parametric emitter (PVDF film, for example, is only a few thousandths of an inch thick), providing the required electrical circuitry, providing sufficient electrical coupling structure, and the like, has maintained the overly large profile of most parametric emitters. Also, reliable electrical coupling to very thin film, regardless of overall emitter thickness, has been a particular challenge with PVDF film.

SUMMARY OF THE INVENTION

In accordance with one aspect of the invention, a low profile ultrasonic emitter is provided, including a support member operable to support an ultrasonic emittive material. The support member can include a plurality of support ribs, each support rib being spaced from adjacent support ribs and extending longitudinally along the support member. An ultrasonic emittive film is coupled to upper portions of the support ribs so as to be carried by the support member along the ribs, yet free to move in the space between the ribs. A first electric lead can be coupled to a first face of the emittive film and a second electric lead can be coupled to an opposing face of the emittive film. The first and second leads are coupled to their respective faces adjacent one another but staggered from one another so as to not overlap one another when the film is positioned between the leads.

In accordance with another aspect of the invention, methods of constructing low profile emitters in accordance with the features disclosed herein are provided.

In accordance with another aspect of the invention, methods to improve the reliability and efficiency of the electrical contact with the emittive film and thus the performance of a parametric emitter in accordance with the features disclosed herein are provided.

Additional features and advantages of the invention will be apparent from the detailed description which follows, taken in conjunction with the accompanying drawings, which together illustrate, by way of example, features of the invention.

BRIEF DESCRIPTION OF THE DRAWINGS

The following drawings illustrate exemplary embodiments for carrying out the invention. Like reference numerals refer to like parts in different views or embodiments of the present invention in the drawings.

DETAILED DESCRIPTION

Figure 1:
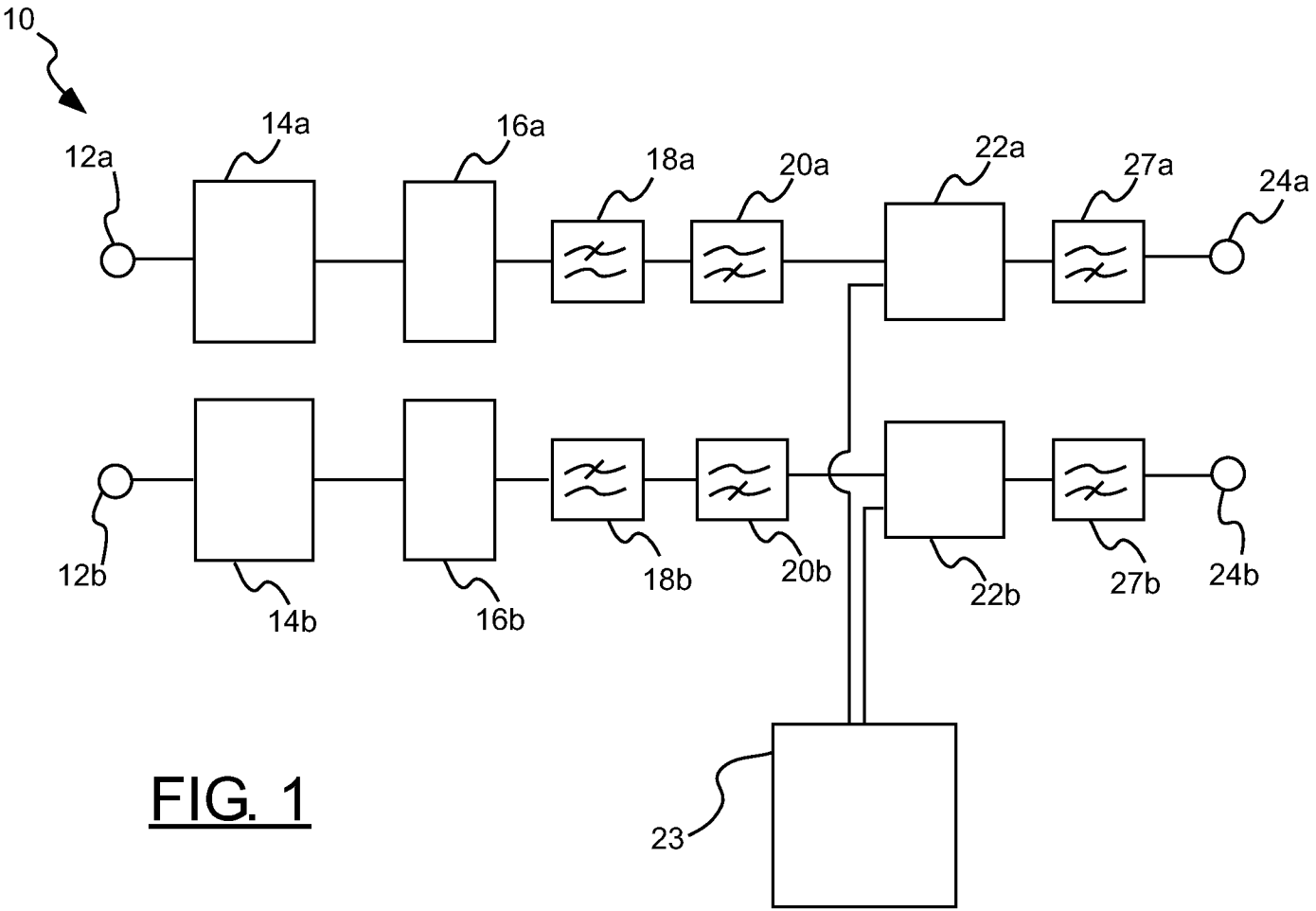
FIG. 1 is a block diagram of an exemplary signal processing system in accordance with one embodiment of the invention.

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention.

DEFINITIONS

As used herein, the singular forms "a" and "the" can include plural referents unless the context clearly dictates otherwise. Thus, for example, reference to "an emitter" can include one or more of such emitters.

As used herein, the term "low profile" refers to the profile of an emitter as viewed from a side edge of the emitter: that is, the profile to which reference is made is the thickness, or depth of the emitter. In other words, an emitter will typically include a height, a width and a depth. A "low profile" emitter, as that term is used herein, is one in which the depth of the emitter is much smaller than acoustically equivalent conventional emitters.

As used herein, the term "substantially" refers to the complete or nearly complete extent or degree of an action, characteristic, property, state, structure, item, or result. For example, an object that is "substantially" enclosed would mean that the object is either completely enclosed or nearly completely enclosed. The exact allowable degree of deviation from absolute completeness may in some cases depend on the specific context. However, generally speaking the nearness of completion will be so as to have the same overall result as if absolute and total completion were obtained. The use of "substantially" is equally applicable when used in a negative connotation to refer to the complete or near complete lack of an action, characteristic, property, state, structure, item, or result. In other words, a composition that is "substantially free of" an ingredient or element may still actually contain such item as long as there is no measurable effect thereof.

As used herein, when reference is made to a "top" or "upper" surface of an emittive film, it is to be understood that such reference is to surface of the film from which acoustic waves are propagated forward, out of the face of an emitter. When reference is made to a "bottom" or "lower" surface of such a film, it is to be understood that such reference is to the opposite side of the film, the side that is directed toward a rear or back side of an emitter.

As used herein, the term "about" is used to provide flexibility to a numerical range endpoint by providing that a given value may be "a little above" or "a little below" the endpoint.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited. As an illustration, a numerical range of "about 1 to about 5" should be interpreted to include not only the explicitly recited values of about 1 to about 5, but also include individual values and sub-ranges within the indicated range. Thus, included in this numerical range are individual values such as 2, 3, and 4 and sub-ranges such as from 1-3, from 2-4, and from 3-5, etc., as well as 1, 2, 3, 4, and 5, individually.

This same principle applies to ranges reciting only one numerical value as a minimum or a maximum. Furthermore, such an interpretation should apply regardless of the breadth of the range or the characteristics being described.

Invention

The present invention relates to improved ultrasonic emitter configurations for use in a variety of audio applications. More specifically, the emitters disclosed herein have proven exceptionally effective for use in parametric sound systems. The emitters described herein have proven to be as much, or more, efficient than conventional parametric emitters, while allowing the provision of a very low profile emitter. That is, the depth or thickness of the present emitters can be reduced considerably from the depth or thickness of acoustically equivalent emitters.

In addition, the present inventive designs can provide larger surface emitters than previously possible, while maintaining a low profile and while also maintaining adequate electrical contact between the emittive film and other components of the emitters. Larger surface emitters are useful for a variety of applications, including sound bars, home theaters, and many others as described herein, or as would be appreciated by one of ordinary skill in the art having possession of this disclosure.

The ultrasonic emitters discussed herein can be used with a variety of signal processing systems that are typically suitable for use in providing one or more ultrasonic signals to one or more emitters in order to create audible sound by way of emission of ultrasonic waveforms. While any number of signal processing systems can be utilized with the present emitters, an exemplary signal processing system 10 is presented in detail as one example of a suitable signal processing system.

Such an exemplary, non-limiting signal processing system is illustrated schematically in FIG. 1. In this embodiment, various processing circuits or components are illustrated in the order (relative to the processing path of the signal) in which they are arranged according to one implementation of the invention. It is to be understood that the components of the processing circuit can vary, as can the order in which the input signal is processed by each circuit or component. Also, depending upon the embodiment, the processing system 10 can include more or fewer components or circuits than those shown.

Also, the example shown in FIG. 1 is optimized for use in processing multiple input and output channels (e.g., a "stereo" signal), with various components or circuits including substantially matching components for each channel of the signal. It is to be understood that the system can be equally effectively implemented on a single signal channel (e.g., a "mono" signal), in which case a single channel of components or circuits may be used in place of the multiple channels shown.

Referring now to the exemplary embodiment shown in FIG. 1, a multiple channel signal processing system 10 can include audio inputs that can correspond to left 12*a* and right 12*b* channels of an audio input signal. Compressor circuits 14*a*, 14*b* can compress the dynamic range of the incoming signal, effectively raising the amplitude of certain portions of the incoming signals and lowering the amplitude of certain other portions of the incoming signals resulting in a narrower range of emitted amplitudes. In one aspect, the compressors lessen the peak-to-peak amplitude of the input signals by a ratio of not less than about 2:1. Adjusting the input signals to a narrower range of amplitude is important to minimize distortion which is characteristic of the limited dynamic range of this class of modulation systems.

Figure 2:
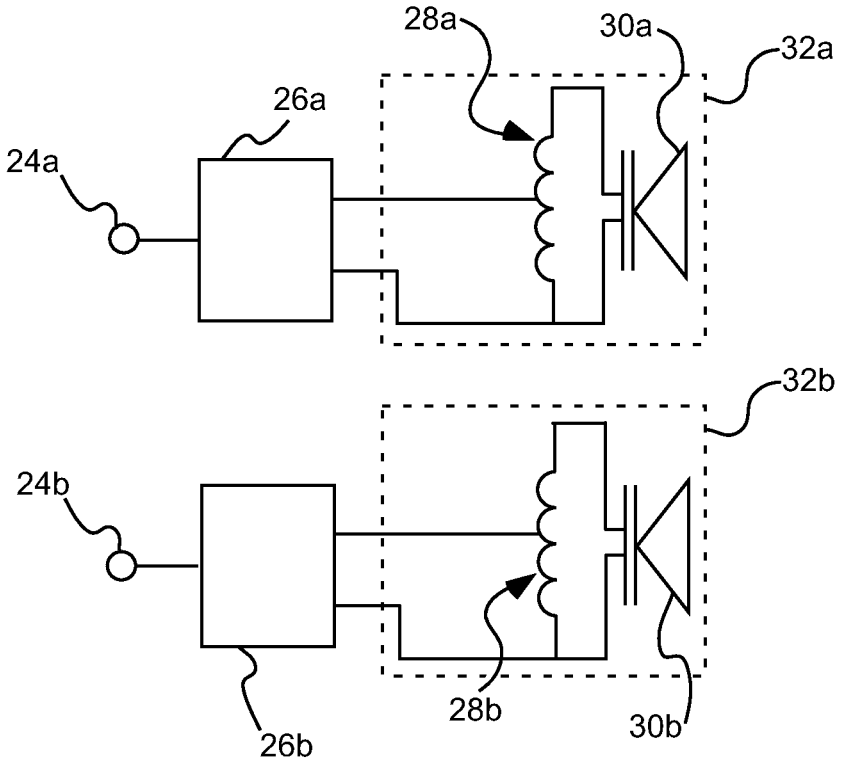
FIG. 2 is a block diagram of an exemplary amplifier and emitter arrangement in accordance with an embodiment of the invention.

After the audio signals are compressed, equalizing networks 16*a*, 16*b* can provide equalization of the signal. The equalization networks can advantageously boost lower frequencies to increase the benefit provided naturally by the emitter/inductor combination of the parametric emitter assembly 32*a*, 32*b* (FIG. 2).

Low pass filter circuits 18*a*, 18*b* can be utilized to provide a hard cutoff of high portions of the signal, with high pass filter circuits 20*a*, 20*b* providing a hard cutoff of low portions of the audio signals. In one exemplarily embodiment of the present invention, low pass filters 18*a*, 18*b* are used to cut signals higher than 15 kHz, and high pass filters 20*a*, 20*b* are used to cut signals lower than 200 Hz (these cutoff points are exemplary and based on a system utilizing an emitter having on the order of 50 square inches of emitter face).

The high pass filters 20*a*, 20*b* can advantageously cut low frequencies that, after modulation, result in nominal deviation of carrier frequency. These low frequencies are very difficult for the system to reproduce efficiently (as a result, much energy can be wasted trying to reproduce these frequencies), and attempting to reproduce them can greatly stress the emitter film (as they would otherwise generate the most intense movement of the emitter film).

The low pass filter can advantageously cut higher frequencies that, after modulation, could result in the creation of an audible beat signal with the carrier. By way of example, if a low pass filter cuts frequencies above 15 kHz, with a carrier frequency of around 44 kHz, the difference signal will not be lower than around 29 kHz, which is still outside of the audible range for humans. However, if frequencies as high as 25 kHz were allowed to pass the filter circuit, the difference signal generated could be in the range of 19 kHz, which is well within the range of human hearing.

In the exemplary embodiment shown, after passing through the low pass and high pass filters, the audio signals are modulated by modulators 22*a* and 22*b*, where they are combined with a carrier signal generated by oscillator 23. While not so required, in one aspect of the invention, a single oscillator (which in one embodiment is driven at a selected frequency of 40 kHz to 50 kHz, which range corresponds to readily available crystals that can be used in the oscillator) is used to drive both modulators 22*a*, 22*b*. By utilizing a single oscillator for multiple modulators, an identical carrier frequency is provided to multiple channels being output at 24*a*, 24*b* from the modulators. This aspect of the invention can negate the generation of any audible beat frequencies that might otherwise appear between the channels while at the same time reducing overall component count.

While not so required, in one aspect of the invention, high-pass filters 27*a*, 27*b* can be included after modulation that serve to filter out signals below about 25 kHz. In this manner, the system can ensure that no audible frequencies enter the amplifier via outputs 24*a*, 24*b*. In this manner, only the modulated carrier wave is fed to the amplifier(s), with any audio artifacts being removed prior to the signal being fed to the amplifier(s).

Thus, the signal processing system 10 receives audio input at 12*a*, 12*b* and processes these signals prior to feeding them to modulators 22*a*, 22*b*. An oscillating signal is provided at 23, with the resultant outputs at 24*a*, 24*b* then including both a carrier (typically ultrasonic) wave and the audio signals that are being reproduced, typically modulated onto the carrier wave. The resulting signal(s), once emitted in a non-linear medium such as air, produce highly directional parametric sound within the non-linear medium.

For more background on the basic technology behind the creation of an audible wave via the emission of two ultrasonic waves, the reader is directed to numerous patents previously issued to the present inventor, including U.S. Pat. Nos. 5,889,870 and 6,229,899, which are incorporated herein by reference to the extent that they are consistent with the teachings herein. Due to numerous subsequent developments made by the present inventor, these earlier works are to be construed as subordinate to the present disclosure in the case any discrepancies arise therebetween.

The signal processing system can advantageously produce output that can be connected to and used by a variety of emitter types. In one example, an ESMR (electrically sensitive and mechanically responsive) film emitter has been found to be particularly effective. Some exemplary, conventional ESMR film emitters are discussed in U.S. Patent Publication No. 2005/0100181, which is hereby incorporated herein by reference to the extent it is consistent with the teachings herein (however, the earlier work is to be construed as subordinate to the present disclosure in the case that any discrepancies exist therebetween).

One specific exemplary emitter provided by the present system is illustrated generally at 30*a* in FIG. 3A through FIG. 12. In this a spect of the invention, a support member 50 can include a plurality of support ribs 51 which generally extend longitudinally along the support member (note that they could also extend laterally across the support member, depending upon the configuration desired). A series of gaps or air spaces 53 can be defined between the support ribs. An ultrasound emittive material (such as an ESMR film) 52 can be attached to the support member 50 across upper surfaces of the support ribs. When provided with a signal from the signal processing system 10 (not shown in these figures), the ultrasound emittive material propagates a parametric wave, resulting in the formation of a highly directional sound column (not shown in detail in the drawings).

General operation of the emittive film 52, as well as attachment methods for attaching the emittive film to the support ribs 51, is/are disclosed in various other applications to the present inventor. Generally speaking, however, output from a signal processing system (for example output from 24*a* or 24*b* of FIG. 1) must be provided to the emittive film by way of an electrical lead or attachment (as well as, possibly, a common or ground lead or attachment). The present inventor has found that the manner in which these electrical connections are made with the emittive film can greatly affect the performance and lifespan of the emitter. The remaining figures and discussion are directed towards manners of coupling electric leads to the emittive film in manners that provide optimal performance of the emittive film, with extended life of the system as a whole, while also providing the most streamlined, low profile design possible.

While much of the discussion herein relates to "coupling" or "connecting" electrical leads to emittive film, it is to be understood that, in many cases, only solid contact need be made between electric leads and the film in order for the system to operate properly. Thus, it may be the case that electrical contact can be maintained by simply compressing an electrical lead against an emittive film, without actually bonding or adhering the lead to the film. As such, when the terms "connecting" or "coupling" are used herein, it is to be understood that such connecting or coupling can include bonding interfaces, compression interfaces, and the like.

Figure 3A:
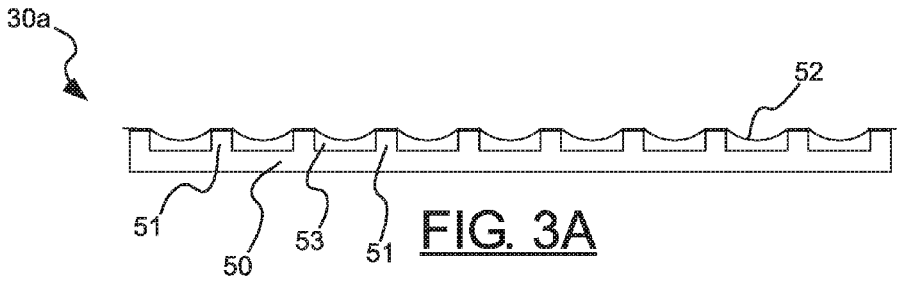
FIGS. 3A through 12 include a series of drawings illustrating various steps used to create electrical connections with an emittive film in a low profile emitter having with improved electrical contact with the emittive film in accordance with an embodiment of the invention.
Figure 3B:
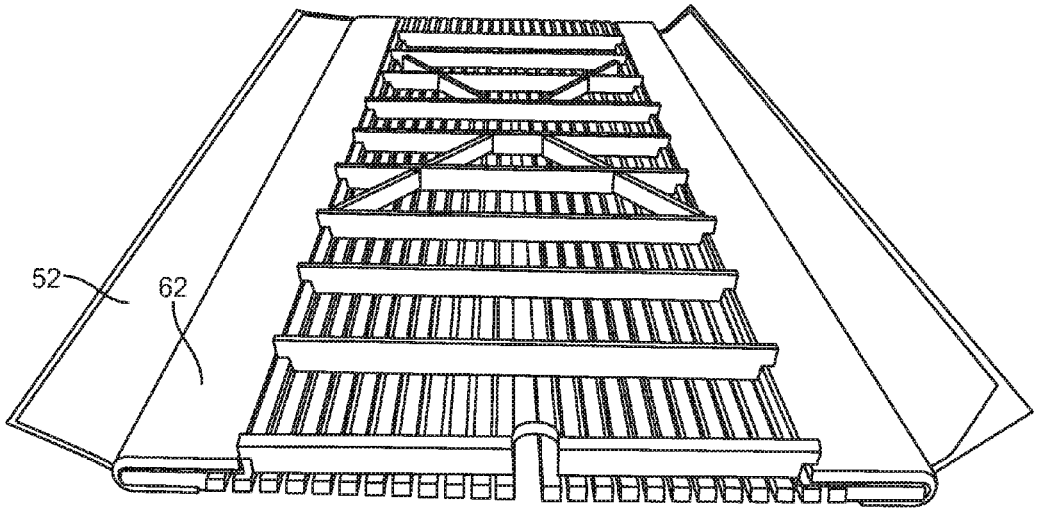
Figure 12:
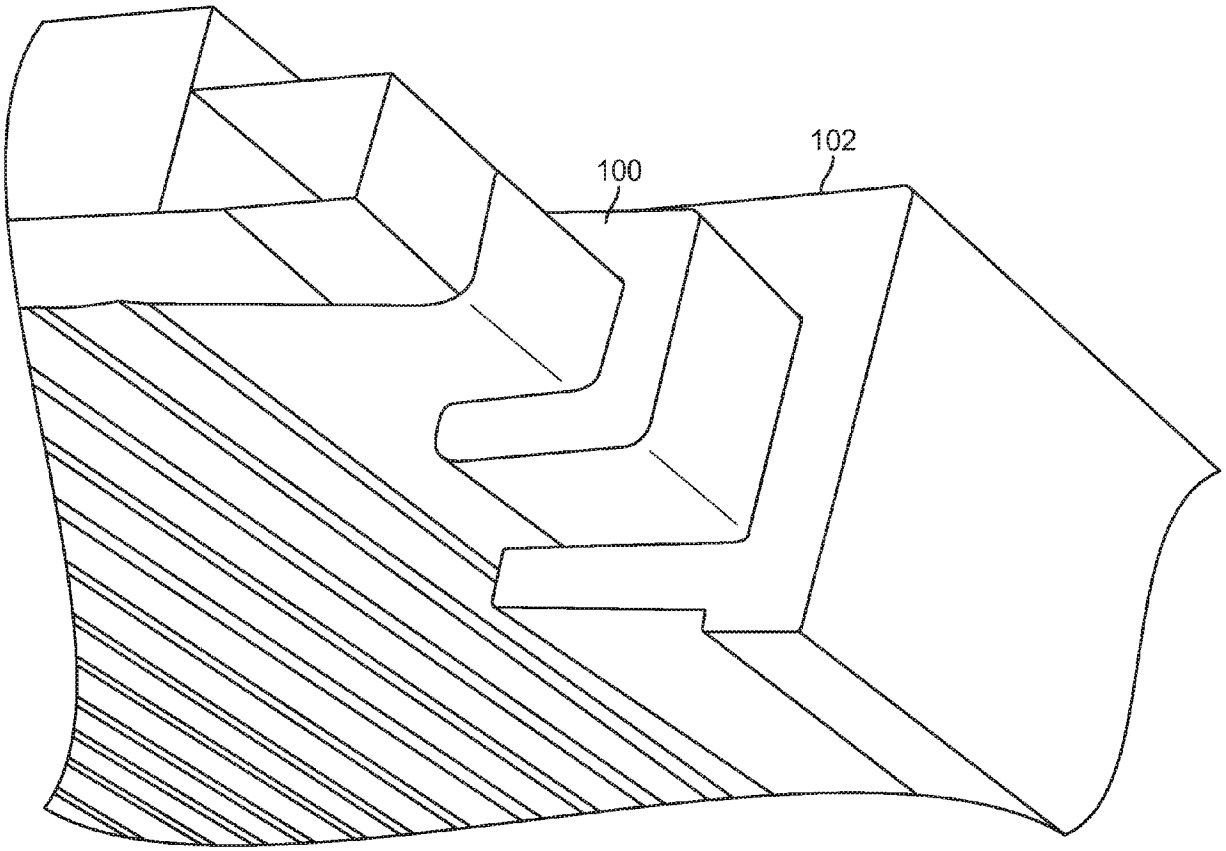

FIG. 3B though FIG. 12 illustrate exemplary manners in which the present technology can be carried out. In FIG. 3B, a support member 50 is shown (oriented with it emittive face directed downwardly) that includes a pair of wrap edges 60 (FIG. 4) coupled to or extending from the support member. The wrap edges can include a rounded edge 61 (best seen in FIG. 4) that allows the emittive film 52 to wrap about the support member (from a front or face of the support member to a rear or bottom of the support member) while preventing the film from becoming sharply creased or folded.

The present inventor has found wrapping the film around sharp corners, or creasing or folding the film, can cause a reduction in the ability of the film to conduct, thereby decreasing or significantly compromising the output of the emitter. It has also been found that the emittive film can be more prone to cracking or breaking (even when not visible to the human eye) when subject to sharp turns, or contacting sharp edges on the support member.

Thus, the wrap edges 60 can include a rounded profile that generally includes a continuous curvature with few or no sharp angles or edges. While the embodiments shown in the figures include a soft, compressible material wrapped about the rounded corners, in some embodiments, a compressible material is not required, so long as the polymer (or other material) from which the support member is formed includes rounded, curved or other profiles that do not include sharp edges.

Figure 4:
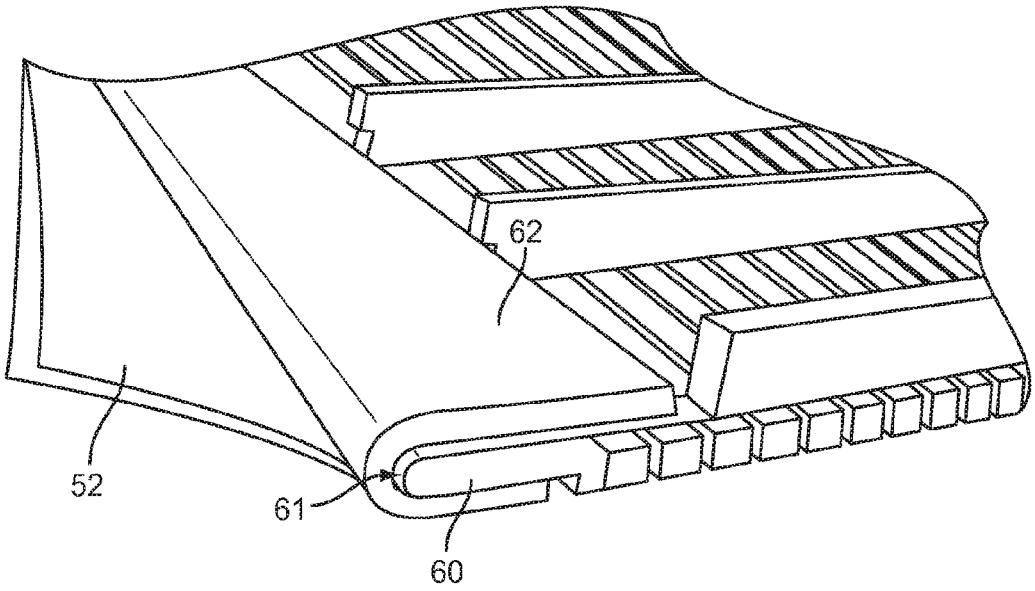

In the phase of construction illustrated in FIG. 3B, the emittive film 52 has been attached to the support ribs 51 (FIG. 3A) of the support member 50, and the emittive film is shown extending beyond lateral edges of the support plate (it also extends beyond wrap edges 60). A compressible, generally non-electrically conductive support material 62 is shown adhered to the wrap edges 60 to provide support to the film in this area, as will be discussed in more detail below. FIG. 4 illustrates a more detailed view of one wrap edge of the stage illustrated in FIG. 3B.

While the compressible support material 62 can take a variety of forms, in one aspect of the invention, the compressible support material 62 is formed from a material sold commercially under the trademark PORON. In the examples shown, the PORON used was sold by McMaster, P/N 86375K162, extra firm, and included a thickness of 1/16 of an inch, having an adhesive back (which is used to adhere the PORON to the wrap edges). PORON is marketed as "quick-recovery super-resilient foam." While the compressible support material is not limited to PORON, or even foam, for the sake of convenience, the compressible support material is sometimes referred to herein as "foam." It is to be understood, however, that a variety of suitable materials can be utilized as the compressible support material, and no limitation is to be read into the use of the term "foam."

The present inventor has found that electrical contact along the edge of the emitter film with any material is generally improved using a compressible material and moderate pressure to insure that the film is actively in contact with the electrical conductive contact lead material. In some aspects, this pressure is maintained throughout the useful life of the emitter to ensure a more consistent, efficient and reliable electrical contact with the emittive film.

Figure 5:
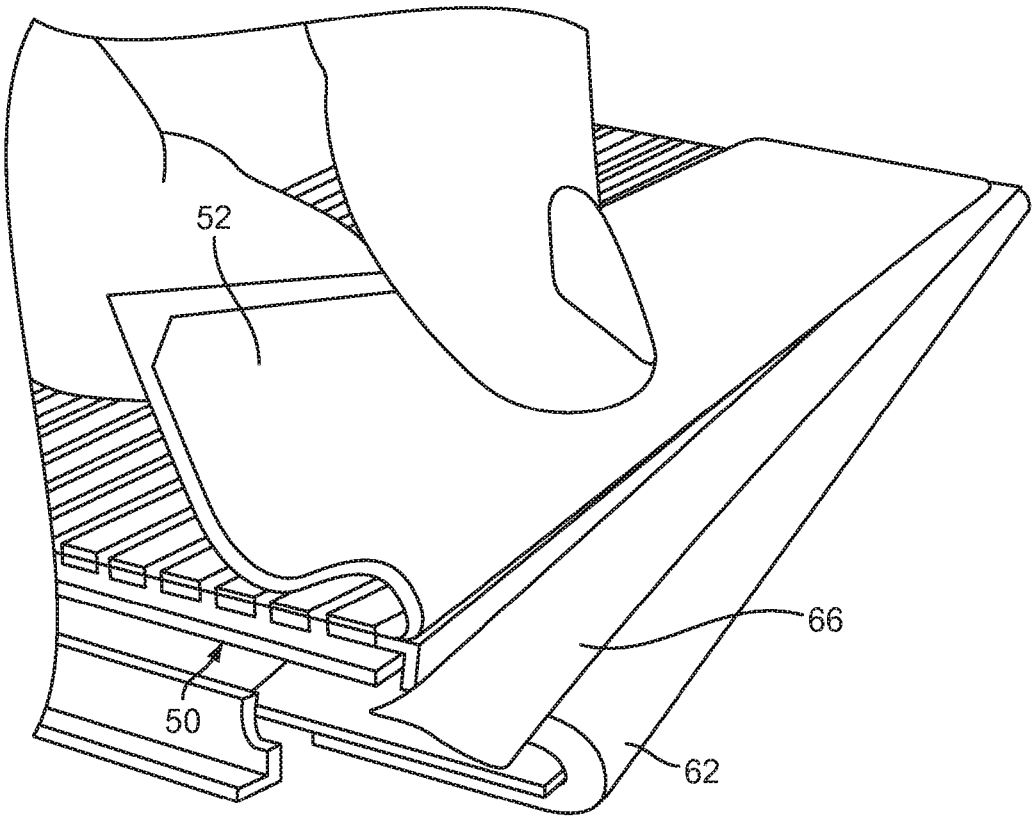

FIG. 5 illustrates the support member 50 of FIG. 3B (shown now "face up") with the emittive film 52 pulled away from the wrap edge and the foam to illustrate an electrical lead 66 extending along the foam (note that two such leads are present—one on each lateral edge of the support member). The lead 66 can be adhered to the foam, or can, for purposes of this embodiment, simply extend along the foam. The electrical lead in this example is a thin strip of conductive material, such as copper, brass or aluminum or the like. The electrical lead can be purchased as "conductive tape," with conductive adhesive applied to one or both sides of the tape. However, non-adhesive strips of conductive material can also be utilized.

The present inventor has found that, in some applications, applying the conductive side of the tape to the emittive film can produce poor electrical conductivity. Thus, in some aspects of the invention, the conductive side of the tape is used only to hold the tape in position, with the conductive tape remaining in intimate contact with the film under moderate pressure to maintain consistent contact all along the film surface.

Thus, it will be appreciated that as the emittive film is allowed to fall back over position onto the electrical lead 66, electrical contact can be made between the back, or lower, side of the emittive material and the electrical lead 66.

Figure 6:
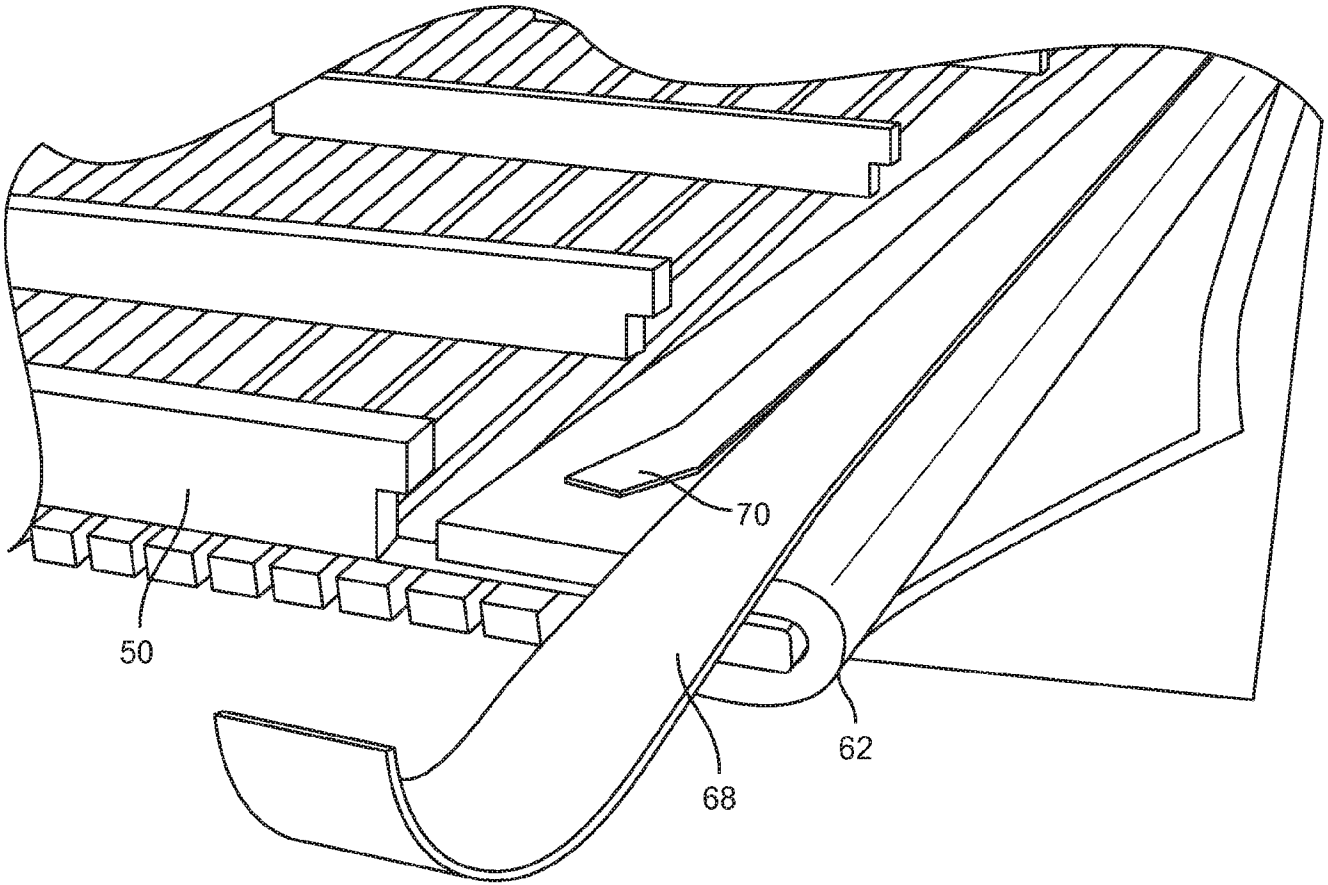
Figure 7:
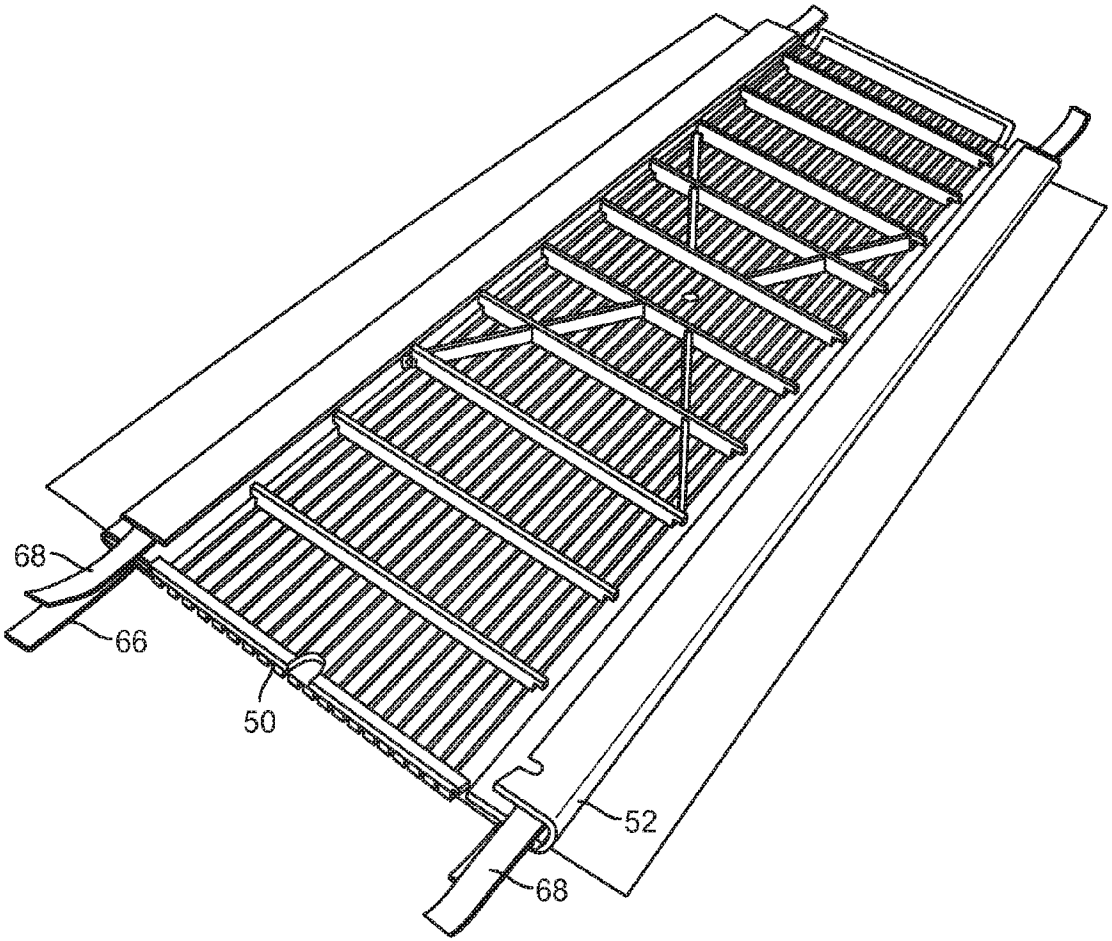

Turning to FIG. 6, the support member 50 is again turned with its face oriented downward. An additional electrical lead 68 is shown attached (or extending) along lateral edges of the back (or bottom) side of the foam 62. A small strip of adhesive 70 is shown adjacent the electrical leads. As shown in FIG. 7, the emittive film 52 can be wrapped about the rounded corners of the wrap edge and secured to the adhesive strip 70. As will be appreciated by one of ordinary skill in the art, as the film is wrapped about the edges and secured to the adhesive strip, it lays atop the leads 68, thereby making electrical contact between the leads and the rear (or back) side of the emittive film.

Figure 8:
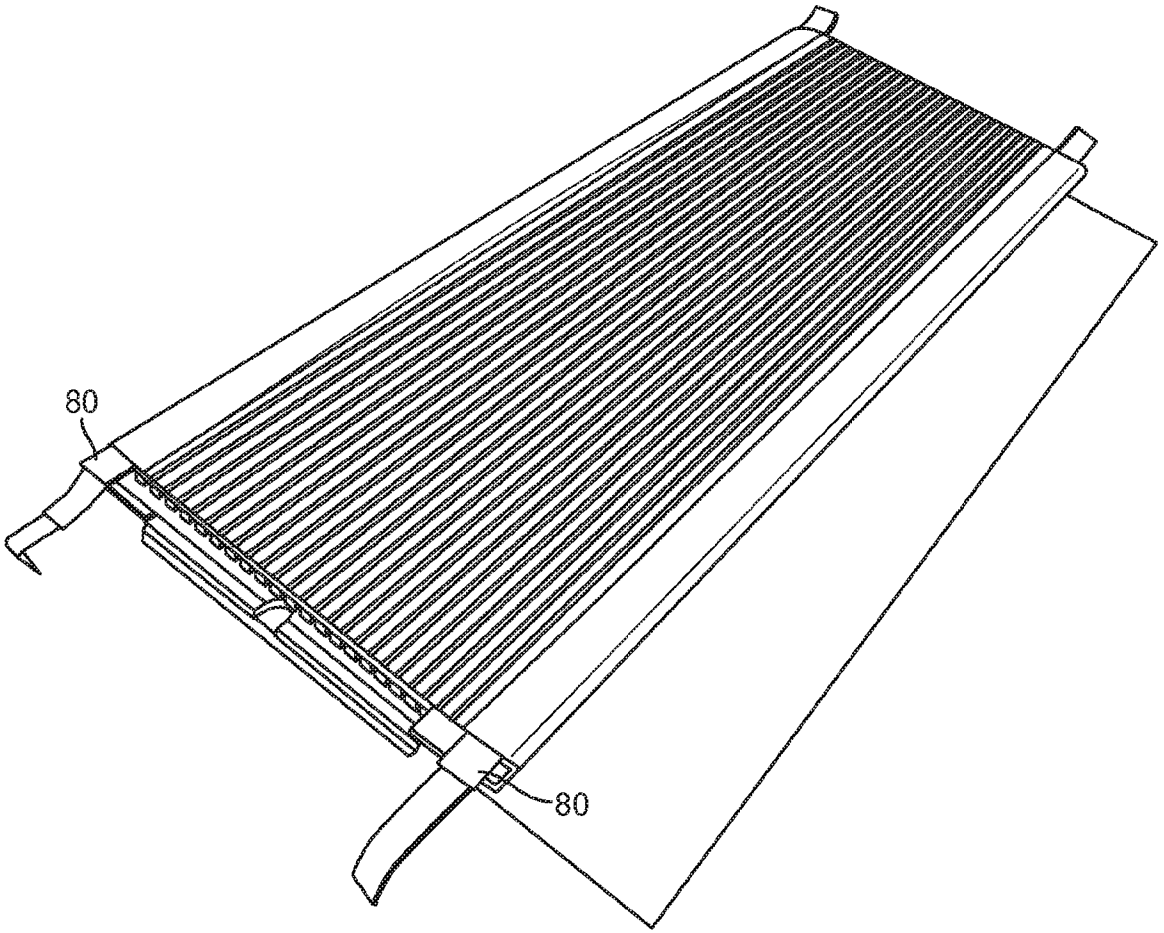
Figure 9:
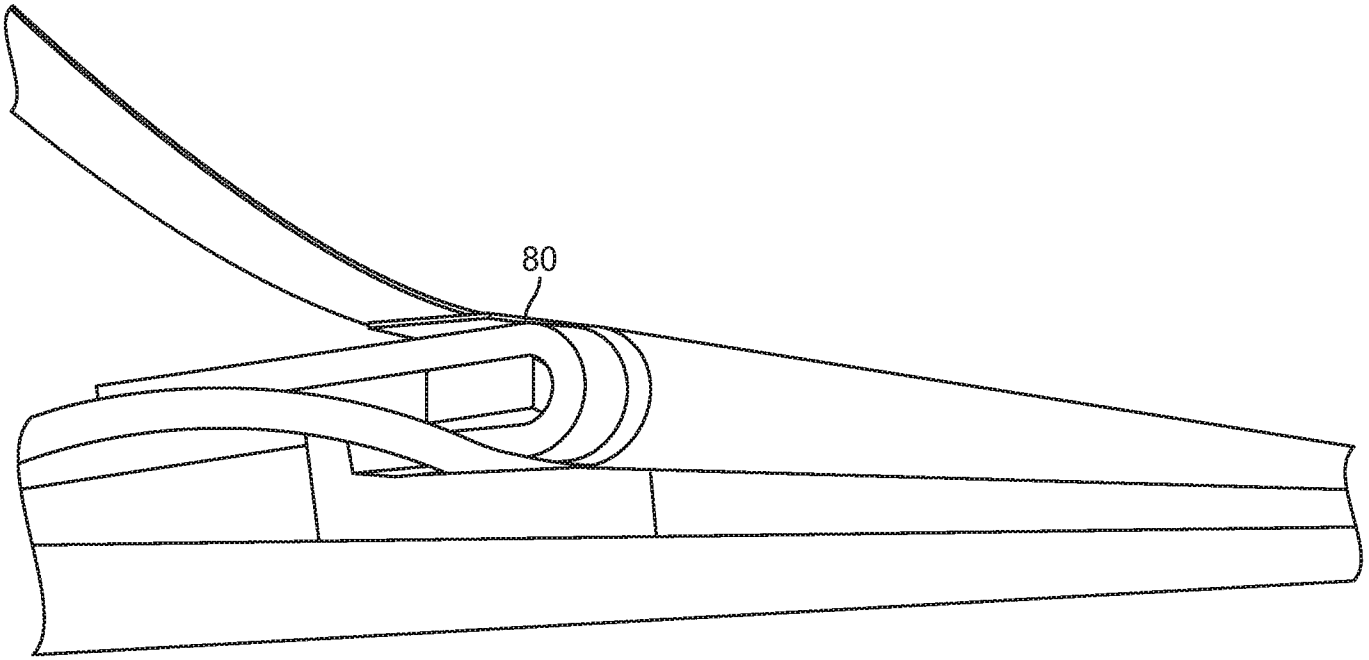

FIGS. 8 and 9 illustrate the emitter shown in a "face up" orientation. Electrically insulating pads 80 can positioned on upper or rear portions on any or all of the electrical leads at the location where the leads extend beyond the electrically sensitive portion of the emittive film. This can ensure, for example, that the electrical leads don't short to each other, or to any other component of the emitter or cabinet or casing that holds the emitter support.

Figure 10:
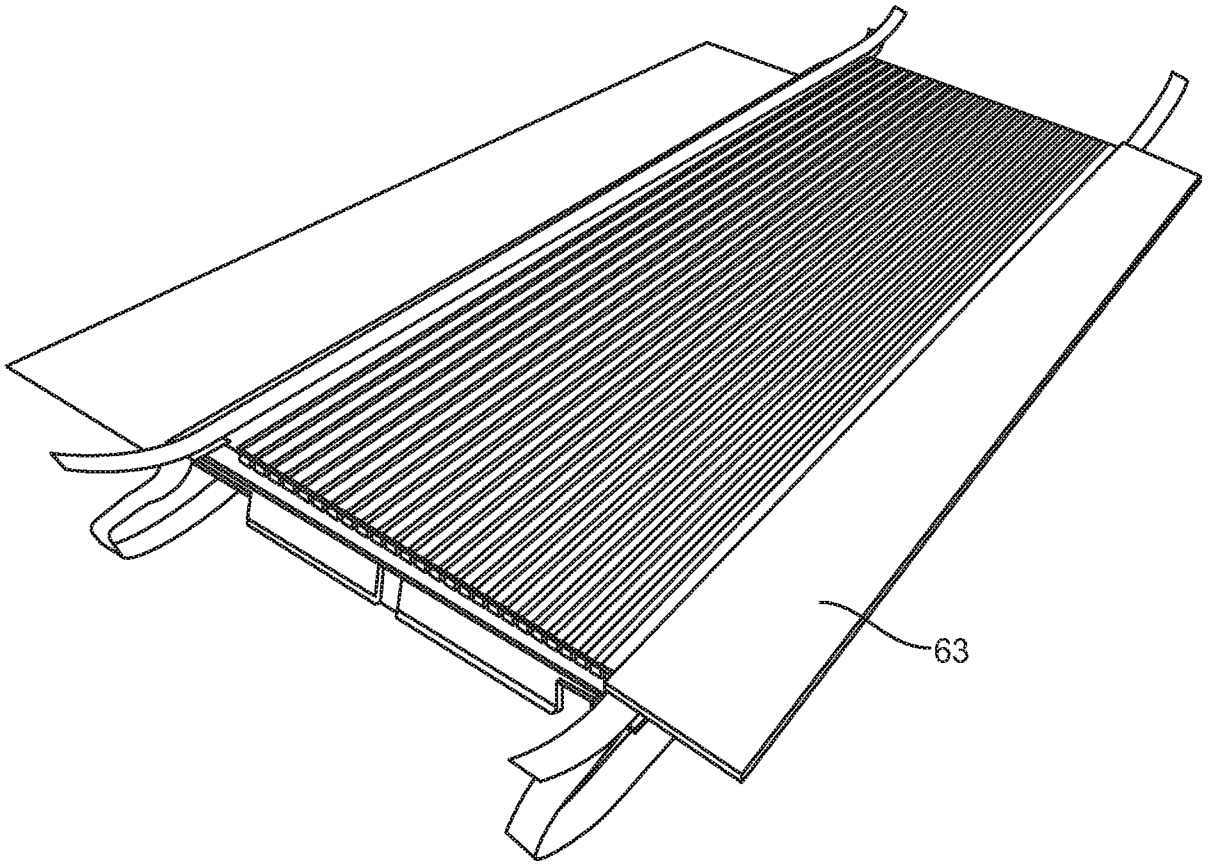
Figure 11:
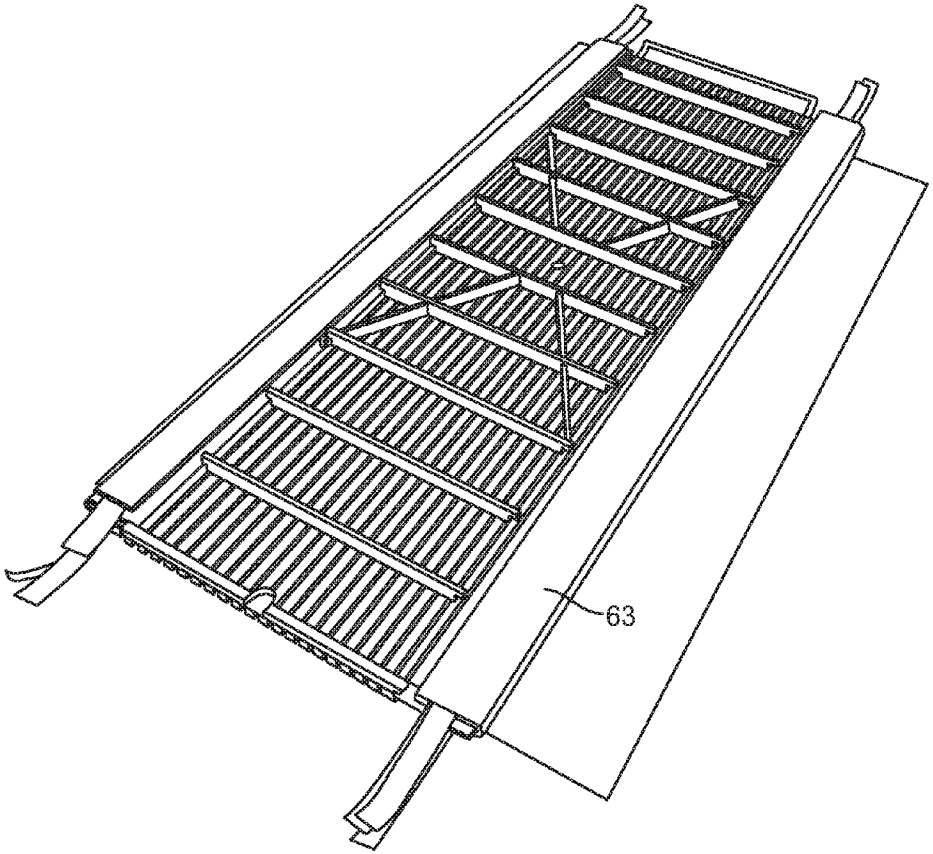

FIGS. 10 and 11 illustrate another application of the invention in which an additional layer of foam 63 is attached over the emittive film (which is already overlapping or connected over the electrical lead). This outer layer of foam can serve as a compression aid to evenly distribute clamping forces that are applied to retain the components in contact with one another. In practice, suitable clamping structure, such as a relatively rigid "C"-channel or other suitable structure (not shown), can be applied over the outer layer of foam 63 to secure the assembly within a suitable cabinet or casing (not shown). The electrical leads can then be relatively easily connected to a signal input or common or ground.

While many of the embodiments discussed herein include relatively thin strips of electric leads (similar to "tape"), it is to be understood that wires (either round or flat in cross section) or thin rods can also be used for the leads instead of thin, flat strips of conductive material. These wires may be copper or brass or alloys or the like. Also, in some embodiments, both sets of leads can be positioned on the front face of edges extending from the emitter support member. By having both sets of leads positioned on the front face of the emitter, wrapping the emittive film around edges of the emitter can be avoided; allowing for an even lower profile emitter design. However, doing so can also diminish, to some degree, the output of the emittive film near the lateral edges of the film if the leads are too closely positioned to each other.

Generally speaking, the sets of leads installed on opposing dies of the film panel are offset from one another: that is, they are staggered so that they are not positioned directly above and below each other with the film between them. If the leads are positioned directly above and below each on opposing sides of the film, small irregularities or pores in the emittive film can allow arcing between the two sides of the film. Arcing between the two leads can significantly affect performance of the unit, and can create a safety hazard, as the film may be melt or burn due to the arcing. By staggering the placement of the leads (whether they be strips of conductive material, or wires or rods), this risk is eliminated.

FIG. 12 illustrates another exemplary embodiment of the invention, in which the electrical leads are attached in much the same manner as discussed above. In this embodiment, however, a generally "C"-shaped foam channel 100 is used to compress the materials together and is held by cabinet component 102 that serves to clamp the components to one another.

Figure 13:
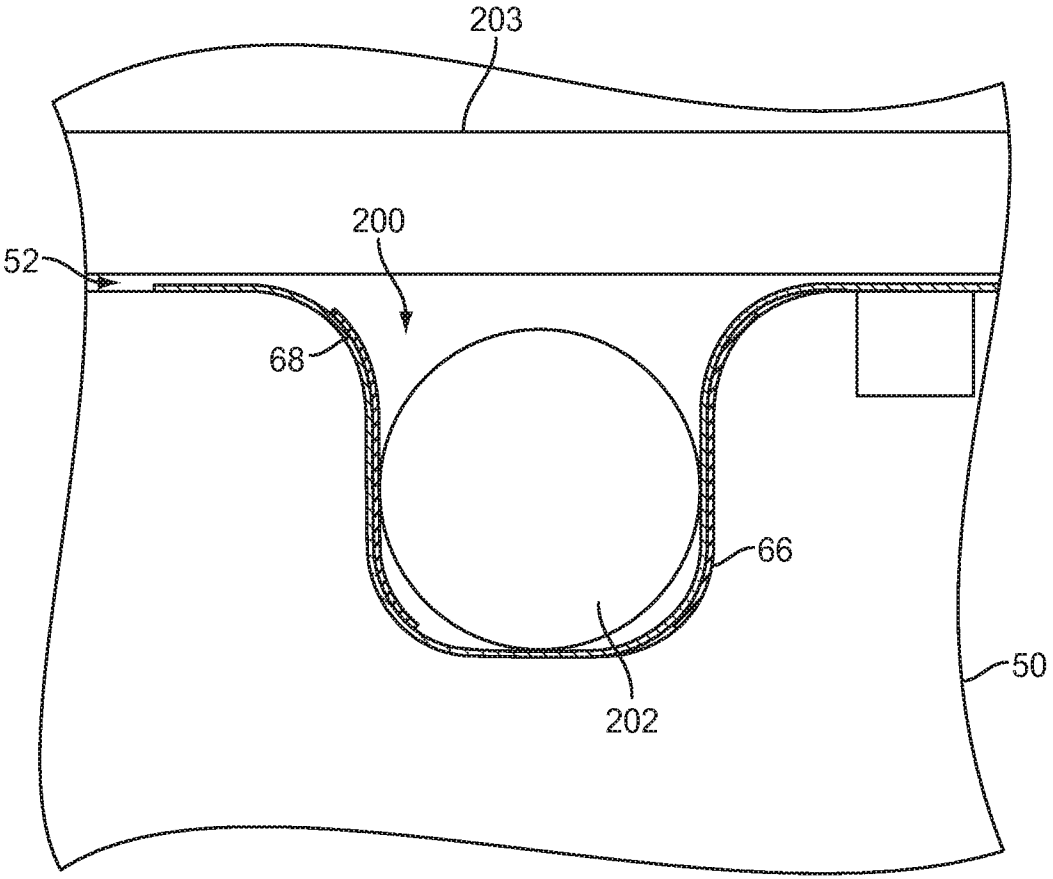
FIG. 13 illustrates another embodiment of the invention showing another manner of creating electrical connections with an emittive film in a low profile emitter.

FIG. 13 illustrates another exemplary embodiment of the invention in which a channel 200 and an "O"-ring type gasket 202 are used to retain the various components in compressed contact with one another. Note that exemplary cover plate 203 is shown positioned over the assembly.

Figure 14:
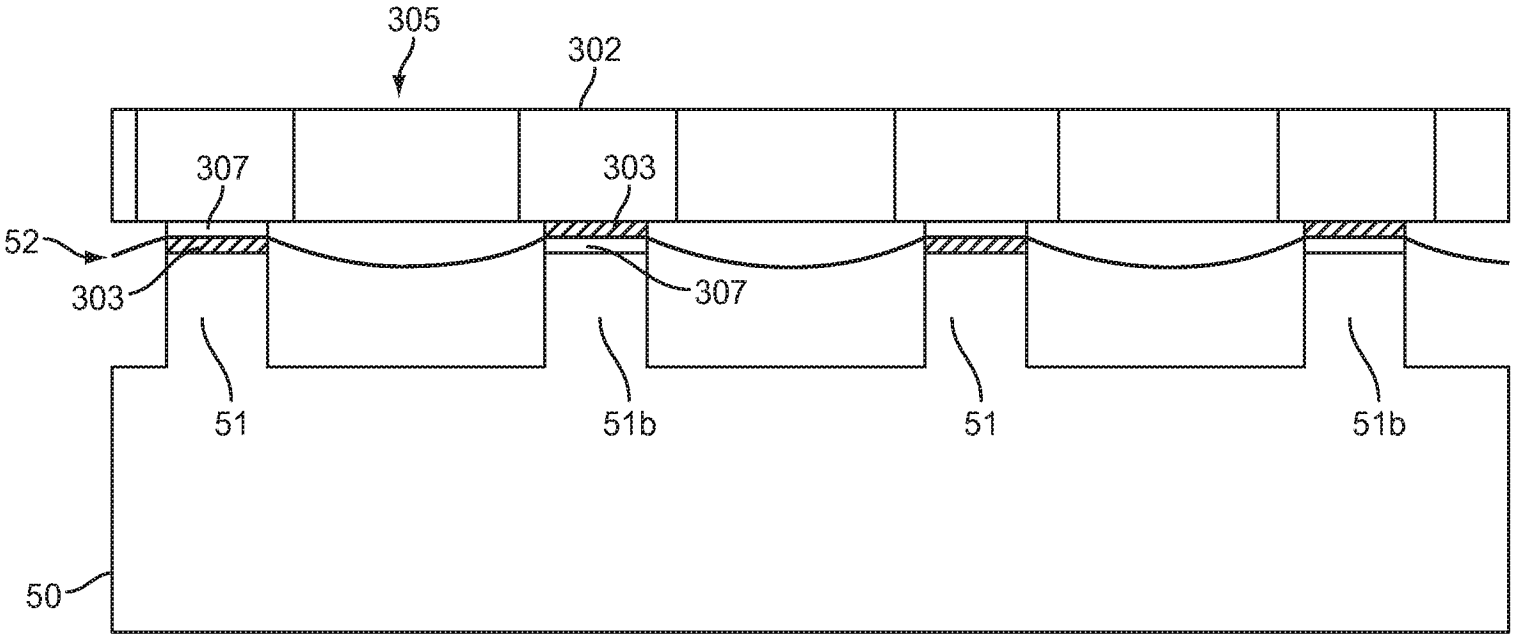
FIG. 14 illustrates another embodiment of the invention showing another manner of creating electrical connections with an emittive film in a low profile emitter.

FIG. 14 illustrates another exemplary embodiment of the invention in which electrical contact is made with the emittive film while also adhesively attaching a grate or cover 302 to the support ribs 51. In this embodiment, electric contact is made with the bottom (or rear) face of the emittive film along support ribs 51 (which alternate with support ribs 51*b*). Electrically conductive adhesive 303 is used between the support ribs 51 and the bottom of the emittive film. The electrically conductive adhesive extends to one or both ends of the ribs (e.g., into or out of the page of FIG. 19), where the adhesive strips associated with ribs 51 are electrically connected one to another, and to an incoming electronic signal, or common or ground. Non-electrically conductive adhesive 307 can be used atop support ribs 51*b* and between the upper (or outer) face of the emittive film and the protective grate attached thereto.

Note the protective grate has a multitude of acoustic emission orifices 305 (e.g., holes or openings) formed therein to allow the acoustic waves emitted by the emittive film to radiate outwardly from the emitter. As with the adhesive strips associated with support ribs 51, the strips associated with support ribs 51*b* can extend to one or both ends of the ribs, where the adhesive strips are electrically connected one to another, and to an incoming electronic signal, or common or ground.

The present invention thus provides various manners of securely attaching electrical leads to a very thin (and somewhat fragile) emittive film in ways that allow for a very low profile emitter assembly to be created. Using the techniques discussed herein, the emitter can be made nearly as thin as the support member, with only marginal securing structure positioned above and below edges of the support member. This low profile can be provided while also ensuring that the emittive film is contacted all along at least two of four edges of the film, providing good electrical flow across the film for maximum film output. This is important for both thin emitters and for larger surface area emitters.

The low profile emitters made capable by the present invention can be used in a myriad of applications that can greatly benefit from their use. As the emitters can also be made highly directional, applications not considered beneficial, possible (or even considered at all) with conventional audio speakers and conventional directional emitters can be achieved.

Applications for which the present emitters are well suited include, without limitation: Paging Systems, toys/novelty products, cinema/theater, sound reinforcement, museums, retail stores, digital signage, point of sale displays, amusement/theme parks, kiosks, ATMs, crosswalks, talking pictures/paintings trade shows/events, audio and/or video conferencing, noise cancellation, military communications, aircraft communications, computer/telephone workstations, speaker phones, computers, video gaming, slot machines, electronic gaming, automobiles (cars, trucks, SUVs, etc.), boats/yachts/airplanes, televisions, soundbars, stand alone speakers, surround sound speakers, rear channel speakers, IPod/IPod and other mobile devices and tablets, headsets (virtual and real), radios, assisted listening devices/personal sound amplifiers, hearing aids, commercial ceiling and wall speakers, outdoor venues, recreational and sport speakers (indoor/outdoor), simulators and other training systems, backup, alert and warning speakers, hailing and warning, alarm/security applications, bird and predator warning/dispersion, professional and concert speakers, microphone applications, ambulances, fire trucks, bullhorn, portable fire rescue, paramedic trucks, boats and ships, helicopters, multilingual speakerphones (each side does a language), sporting events, bicycles, search and rescue, perimeter security, border security, churches & synagogues, cue actors on stage, public address systems, flight deck communications, language translation, wayfinding, steerable arrays, tracking speakers that follow heat or movement and direct audio thereto, medical for treating tinnitus, music therapy for many ailments (the treatment can be focused at particular treatment patient within a group or room/building), etc.

In addition to the structure outlined above, the present invention also provides a method of constructing a lower profile, parametric emitter, as outlined in the description above and shown in the attached figures.

It is to be understood that the above-referenced arrangements are illustrative of the application for the principles of the present invention. Numerous modifications and alternative arrangements can be devised without departing from the spirit and scope of the present invention while the present invention has been shown in the drawings and described above in connection with the exemplary embodiments(s) of the invention. It will be apparent to those of ordinary skill in the art that numerous modifications can be made without departing from the principles and concepts of the invention as set forth in the examples.

We claim:

1. A low profile ultrasonic emitter, comprising:

a support member operable to support an ultrasonic emittive material, the support member including a plurality of support ribs, each support rib being spaced from adjacent support ribs and extending along the support member, the support member including at least one wrap edge around which an emittive film can be wrapped, the wrap edge including a rounded profile, and an upper planar portion and a lower planar portion on opposing sides of the support member, each of the upper planar portion and the lower planar portion being positioned adjacent to the rounded profile;

an ultrasonic emittive film coupled to upper portions of the support ribs so as to be carried by the support member;

a first electric lead in contact with a first face of the emittive film; and a second electric lead in contact with an opposing face of the emittive film;

the first electric lead and the second electric lead being in contact with the first face and the second face, respectively, at staggered locations so as to not overlap one another when the film is contacting the leads;

wherein at least one of the first and second leads extends parallel to the rounded profile and is positioned between the emittive film and one of: i) the upper planar portion of the wrap edge and ii) the lower planar portion of the wrap edge.

2. The emitter of claim 1, wherein one of the first and second leads is in contact with the film atop the upper planar portion of the wrap edge, and an other of the first and second leads is in contact with the film atop the lower planar portion of the wrap edge.

3. The emitter of claim 1, wherein the first and second emittive leads are coupled on opposing sides of the emittive film and are positioned adjacent one another atop only one of:

i) the upper planar portion of the wrap edge and ii) the lower planar portion of the wrap edge.

4. The emitter of claim 1, wherein the leads extend along, and make electrical contact with, substantially an entire length of the emittive film.

5. A method of forming a low profile parametric emitter, comprising:

obtaining a support member operable to support an ultrasonic emittive material, the support member including a plurality of support ribs, each support rib being spaced from adjacent support ribs and extending along the support member, the support member having an ultrasonic emittive film coupled to upper portions of the support ribs so as to be carried by the support member, the support member including at least one wrap edge around which an emittive film can be wrapped, the wrap edge including a rounded profile, and an upper planar portion and a lower planar portion on opposing sides of the support member, each of the upper planar portion and the lower planar portion being positioned adjacent to the rounded profile;

positioning a first electric lead in contact with a first face of the emittive film;

positioning a second electric lead in contact with an opposing face of the emittive film;

orienting the first electric lead and the second electric lead so as to be in contact with the first face and the second face, respectively, at staggered locations so as to not overlap one another when the film is positioned between the leads; and positioning at least one of the first and second leads such that it extends parallel to the rounded profile and is positioned between the emittive film and one of: i) the upper planar portion of the wrap edge and ii) the lower planar portion of the wrap edge.

6. The method of claim 5, wherein one of the first and second leads is in contact with the emittive film atop the upper planar portion of the wrap edge, and an other of the first and second leads is in contact with the emittive film atop the lower planar portion of the wrap edge.

7. The method of claim 5, wherein the first and second leads are coupled on opposing sides of the emittive film and are positioned adjacent one another atop only one of: i) the upper planar portion of the wrap edge and ii) the lower planar portion of the wrap edge.

* * * * *